US009302517B2

(12) United States Patent
Watanabe

(10) Patent No.: US 9,302,517 B2
(45) Date of Patent: Apr. 5, 2016

(54) INKJET RECORDING APPARATUS

(71) Applicant: KYOCERA Document Solutions Inc., Osaka-shi, Osaka (JP)

(72) Inventor: Takeshi Watanabe, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/341,685

(22) Filed: Jul. 25, 2014

(65) Prior Publication Data

US 2015/0029272 A1 Jan. 29, 2015

(30) Foreign Application Priority Data

Jul. 29, 2013 (JP) ..... 2013-156553

(51) Int. Cl.
*B41J 2/01* (2006.01)
*B41J 29/38* (2006.01)

(52) U.S. Cl.
CPC ..... *B41J 29/38* (2013.01)

(58) Field of Classification Search
USPC ..... 347/4, 16, 42, 104, 101, 105
See application file for complete search history.

(56) References Cited

U.S. PATENT DOCUMENTS 5,943,081 A * 8/1999 Uchida et al. ..... 347/104
6,097,408 A * 8/2000 Fukushima et al. ..... 347/34
6,309,064 B1 * 10/2001 Tanno et al. ..... 347/104
7,524,005 B2 * 4/2009 Inoue ..... B41J 11/0015 347/101
8,038,280 B2 * 10/2011 Scarlata ..... 347/101
8,251,481 B2 * 8/2012 Ihara ..... 347/16

FOREIGN PATENT DOCUMENTS

JP 2011136468 A 7/2011

* cited by examiner

*Primary Examiner* — Anh T. N. Vo
(74) *Attorney, Agent, or Firm* — Alleman Hall McCoy Russell & Tuttle LLP

(57) ABSTRACT

An inkjet recording apparatus includes a recording portion, a transport mechanism, and a liquid holding portion. The recording portion has a recording head in which a plurality of nozzles for ejecting ink are formed. The transport mechanism is arranged to face the recording portion and transports a paper sheet along the recording portion. The liquid holding portion is provided on an upstream side of the recording portion in a transport direction of the paper sheet, and holds liquid in a state where liquid surface of the liquid faces the transport mechanism.

7 Claims, 5 Drawing Sheets

Fig. 5

| | Y | M | C | K | TOTAL |
|---|---|---|---|---|---|
| COMPARATIVE EXAMPLE 1 | 20 | 2 | 3 | 1 | 26 |
| COMPARATIVE EXAMPLE 2 | 30 | 0 | 2 | 0 | 32 |
| COMPARATIVE EXAMPLE 3 | 27 | 4 | 2 | 0 | 33 |
| AVERAGE | 25.7 | 2.0 | 2.3 | 0.3 | 30.3 |

Fig. 6

| | Y | M | C | K | TOTAL |
|---|---|---|---|---|---|
| EXAMPLE 1 | 2 | 1 | 0 | 0 | 3 |
| EXAMPLE 2 | 0 | 0 | 0 | 0 | 0 |
| EXAMPLE 3 | 1 | 0 | 0 | 1 | 2 |
| AVERAGE | 1.0 | 0.3 | 0.0 | 0.3 | 1.7 |

INKJET RECORDING APPARATUS

INCORPORATION BY REFERENCE

This application is based upon and claims the benefit of priority from the corresponding Japanese Patent Application No. 2013-156553 filed on Jul. 29, 2013, the entire contents of which are incorporated herein by reference.

BACKGROUND

The present disclosure relates to an inkjet recording apparatus.

Inkjet recording apparatuses have a recording head in which a plurality of nozzles for ejecting ink are formed. Serial type inkjet recording apparatuses have a recording head (serial head) that is smaller in size than the width of the paper sheet, and the recording head is reciprocated on the paper sheet in the paper width direction to record an image on the paper sheet. In contrast, line head type inkjet recording apparatuses have a recording head (line head) that is fixed in the apparatus. The line head has a plurality of nozzles that cover the whole area of the paper sheet in the paper width direction. The line head type inkjet recording apparatuses can record images at higher speeds than the serial type inkjet recording apparatuses.

For example, it is known that a plurality of line heads for ejecting ink of different colors are arranged in series in the paper transport direction, and the ink is ejected from the nozzles onto a paper sheet that is transported while facing the series of plurality of line heads so that a color image is recorded on the paper sheet. Also, the inkjet recording apparatuses have a transport mechanism that transports a paper sheet while causing a belt thereof to suck and hold the paper sheet.

SUMMARY

An inkjet recording apparatus according to one aspect of the present disclosure includes a recording portion, a transport mechanism, and a liquid holding portion. The recording portion has a recording head in which a plurality of nozzles for ejecting ink are formed. The transport mechanism is arranged to face the recording portion and transports a paper sheet along the recording portion. The liquid holding portion is provided on an upstream side of the recording portion in a transport direction of the paper sheet, and holds liquid in a state where liquid surface of the liquid faces the transport mechanism.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

FIG. 5 illustrates the measurement results of the Comparative Examples.

FIG. 6 illustrates the measurement results of the Examples.

DETAILED DESCRIPTION

Figure 1:
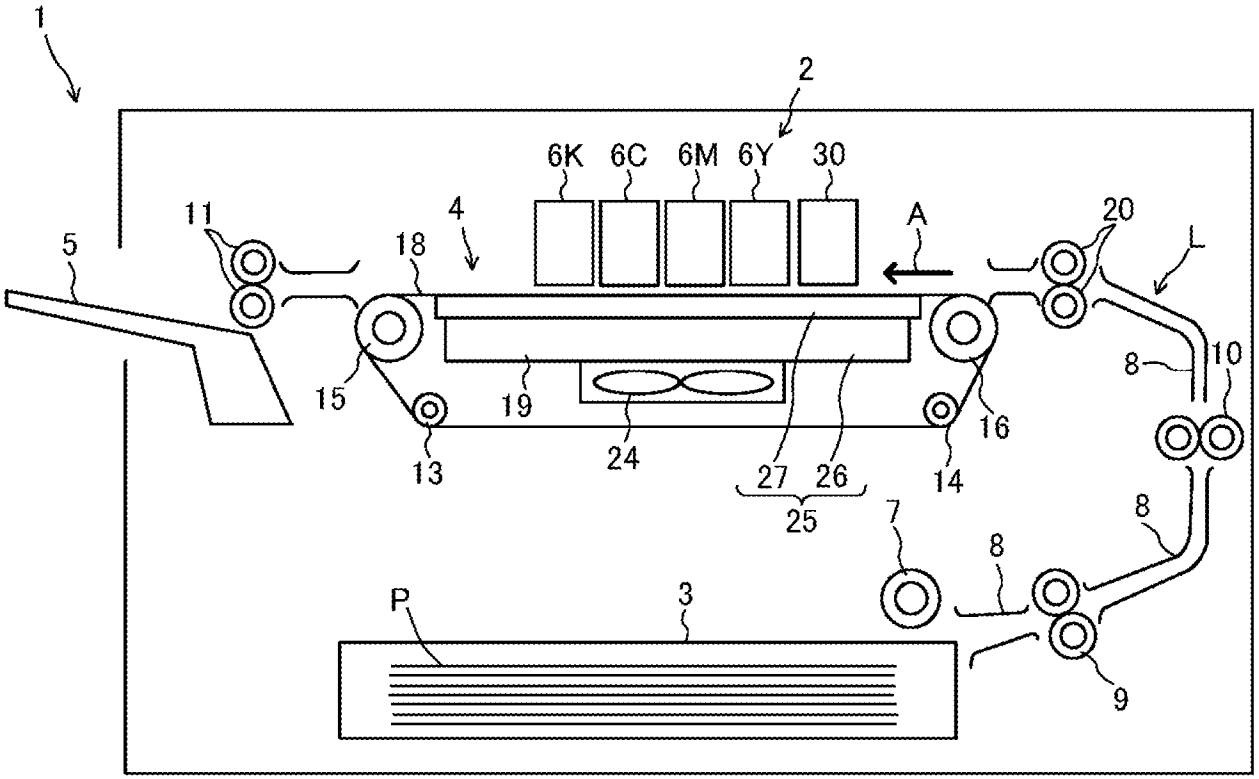
FIG. 1 is a longitudinal section view schematically illustrating an image forming apparatus as an inkjet recording apparatus in an embodiment of the present disclosure.
Figure 2:
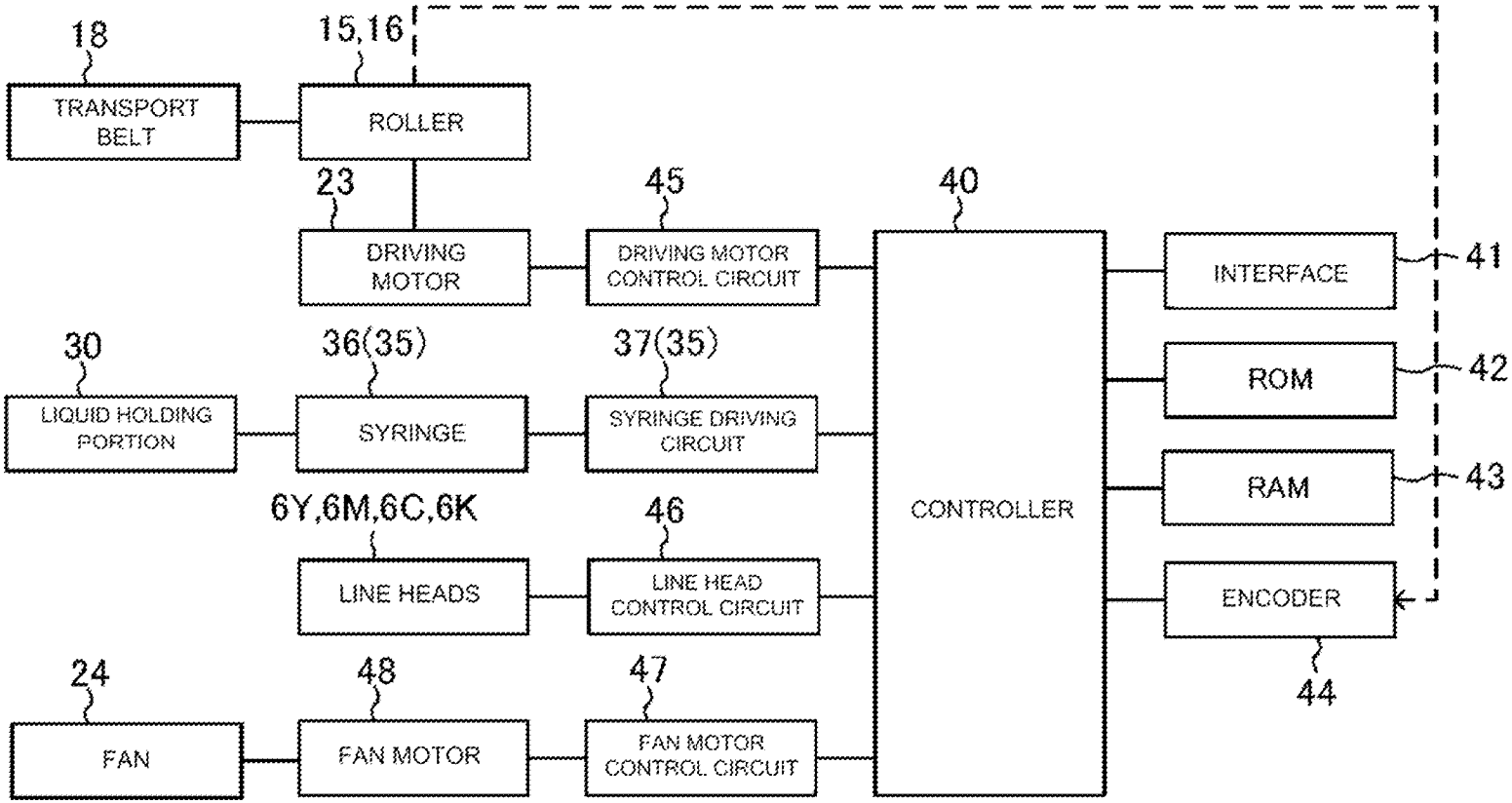
FIG. 2 is a block diagram illustrating the structure of the image forming apparatus in the embodiment of the present disclosure.
Figure 3:
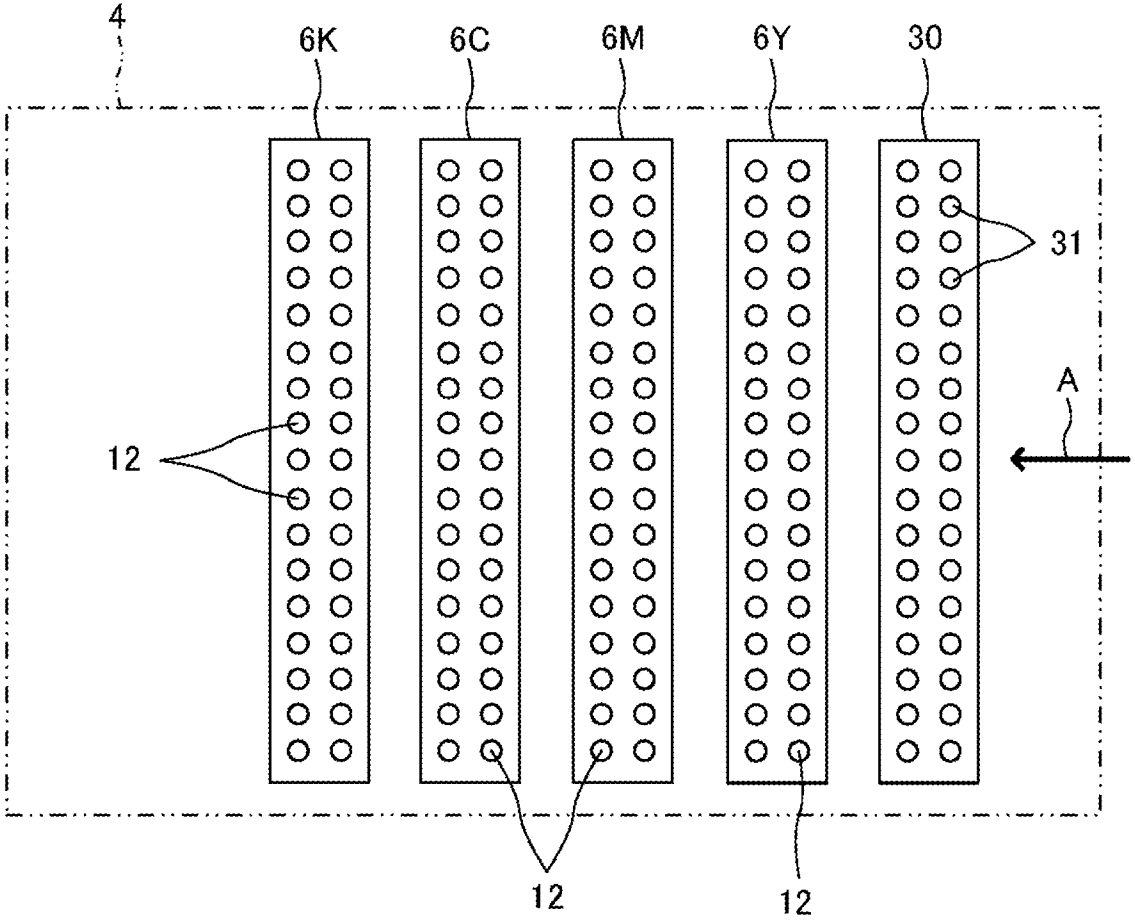
FIG. 3 is a schematic bottom view of the line heads and the liquid holding portion in the embodiment of the present disclosure.

FIG. 1 is a schematic diagram of an image forming apparatus 1 as an inkjet recording apparatus in the present embodiment. FIG. 2 illustrates the structure of the image forming apparatus 1. FIG. 3 is a schematic bottom view of line heads 6Y, 6M, 6C and 6K.

As illustrated in FIG. 1, the image forming apparatus 1 includes: an inkjet head 2 as a recording portion; a paper feed cassette 3 housing paper sheets P that are recording media; a paper transport mechanism 4 arranged to face the inkjet head 2; and a paper output tray 5 on which each paper sheet P, on which an image has been formed, is stacked.

The inkjet head 2 has a line-head-type structure. That is to say, the inkjet head 2 includes a plurality of line heads 6Y, 6M, 6C and 6K as recording heads that are arranged in the sub-scanning direction (the horizontal direction in FIG. 1). The line heads 6Y, 6M, 6C and 6K eject ink of yellow (Y), magenta (M), cyan (C) and black (K) respectively onto the paper sheet P to form an image on the paper sheet P.

As illustrated in FIG. 3, each of the line heads 6Y, 6M, 6C and 6K has a plurality of nozzles 12, through which the ink is ejected, on a lower surface facing the paper transport mechanism 4. FIG. 3 illustrates a smaller number of nozzles than are actually present for the sake of explanation, but in the actuality, a large number of nozzles 12 are provided in matrix.

The line heads 6Y, 6M, 6C and 6K are configured to eject ink from a nozzle 12 when the volume of a pressure chamber (not illustrated) filled with ink is changed by a piezoelectric element (not illustrated).

Meanwhile, image forming apparatuses have a problem that paper dust is generated and stirred up during paper transport, and the paper dust may stick to and clog the nozzles 12 of the line heads 6Y, 6M, 6C and 6K. When the nozzles 12 are clogged, the formed image has white stripes. In particular, in line head type inkjet recording apparatuses, since the paper sheet is transported at higher speeds than in serial type inkjet recording apparatuses, the paper dust is more likely generated and the above-mentioned problem is more prominent. On the other hand, in the image forming apparatus 1, the nozzle clog due to paper dust is restricted from occurring.

As illustrated in FIG. 1, the paper feed cassette 3, provided in the lower portion of the apparatus, can house a plurality of paper sheets P in a stack. The paper feed cassette 3 is provided with a paper feed roller 7 for feeding the paper sheet.

On the side of the paper feed roller 7, a transport path L is provided to guide the paper sheet P fed from the paper feed cassette 3 to the paper transport mechanism 4. The transport path L is defined by guide plates 8. The transport path L is provided with a pair of first transport rollers 9, a pair of second transport rollers 10, and a pair of registration rollers 20, in order from the paper feed cassette 3 side to the paper transport mechanism 4 side. The registration rollers 20 supply the paper sheet P to the paper transport mechanism 4 at a predetermined timing. Furthermore, on the side of the paper transport mechanism 4, a pair of paper ejection rollers 11 and the paper output tray 5 are provided.

As illustrated in FIG. 1, the paper transport mechanism 4 is provided with an annular transport belt 18 and a negative pressure generating apparatus 19. The transport belt 18 is looped over a plurality of rollers 13-16 and holds and transports the paper sheet P. The negative pressure generating apparatus 19 is arranged inside in a diameter direction of the transport belt 18. The paper transport mechanism 4 is arranged to face the inkjet head 2, and is configured to transport the paper sheet P in a paper transport direction A along the inkjet head 2.

The plurality of rollers 13-16 are composed of two tension rollers 13 and 14, a driving roller 15, and a driven roller 16.

The driving roller 15 is a roller for transmitting the driving force to the transport belt 18, and is arranged on the downstream side of the inkjet head 2 in the paper transport direction A. As illustrated in FIG. 2, the driving roller 15 is connected to a driving motor 23 to be capable of transmitting motive power.

The driven roller 16 is arranged on the upstream side of the inkjet head 2 in the paper transport direction A. The driven roller 16 is arranged approximately at the same height as the driving roller 15. The tension rollers 13 and 14 are rollers for adjusting the tension of the transport belt 18, and are placed at lower positions than the driving roller 15 and the driven roller 16.

The upper surface of the transport belt 18 forms a paper transport surface on which the paper sheet P is placed while it is transported. The upper surface of the transport belt 18 extends substantially parallel to the lower surface of the inkjet head 2. The transport belt 18 transports the paper sheet P while sucking and holding the paper sheet P on the upper surface thereof.

A plurality of vents (not illustrated) are formed in the transport belt 18. Each vent goes through the thickness of the transport belt 18. Each vent has a function to cause the negative pressure generated by the negative pressure generating apparatus 19 to act on the paper sheet P.

The negative pressure generating apparatus 19 includes a fan case 25 to which a fan 24 is attached. The fan case 25 includes a case body 26 and a top plate 27. The case body 26 is opened upward. The top plate 27 covers the top side of the case body 26.

The fan 24 is attached to the lower surface of the case body 26. When driven by a fan driving motor (not illustrated), the fan 24 generates a negative pressure in the fan case 25.

The top plate 27 is in contact with the inner circumferential surface of the transport belt 18. When the paper sheet P is held on the upper surface (outer circumferential surface) of the transport belt 18, the top plate 27 supports the paper sheet P from below via the transport belt 18.

A plurality of suction holes (not illustrated) are formed through the thickness of the top plate 27. With this structure, when the fan 24 is activated, a negative pressure is generated in the fan case 25, the negative pressure acts on the paper sheet P on the transport belt 18 via the suction holes and the vents of the transport belt 18.

The paper sheet P fed from the paper feed cassette 3 by the paper feed roller 7 is transported in the transport path L by the first and second transport rollers 9 and 10, and supplied to the paper transport mechanism 4 by the registration rollers 20. Subsequently, an image is formed on the paper sheet P by the inkjet head 2 while the paper sheet P is transported in the sub-scanning direction, and then the paper sheet P is ejected into the paper output tray 5 by the paper ejection rollers 11.

The image forming apparatus 1 is further provided with a liquid holding portion 30. The liquid holding portion 30 is provided on the upstream side of the inkjet head 2 in the paper transport direction A, and holds liquid in a state where the liquid surface faces the paper transport mechanism 4. The liquid holding portion 30 is composed of an inkjet head.

Figure 4:
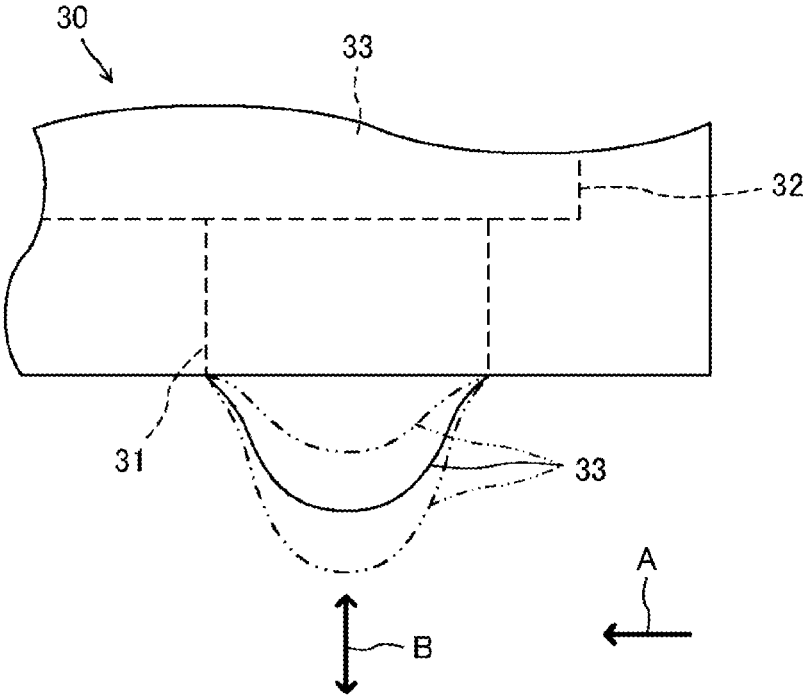
FIG. 4 is an enlarged side view of the liquid held by the liquid holding portion in the embodiment of the present disclosure.

FIG. 4 is an enlarged view of the liquid held by the liquid holding portion 30 and a part of the liquid holding portion 30. As illustrated in FIGS. 3 and 4, as is the case with the line heads 6Y, 6M, 6C and 6K, the liquid holding portion 30 includes: a plurality of nozzles 31 facing the paper transport mechanism 4; a plurality of pressure chambers 32 respectively communicating with the nozzles 31; and a plurality of piezoelectric elements (not illustrated) that change the volume of the pressure chambers 32.

Note that FIG. 3 illustrates a smaller number of nozzles than are actually present for the sake of explanation, but in the actuality, a large number of nozzles 31 are provided in a matrix.

The pressure chambers 32 are filled with liquid 33 which is different from the ink and is, for example, water or preservation liquid. The liquid 33 is desirably transparent. The liquid holding portion 30 is configured to hold the liquid 33 while contracting the pressure chambers 32 to a certain extent so that the liquid 33 in the pressure chambers 32 protrudes from the nozzles 31.

The image forming apparatus 1 is further provided with a liquid surface moving back/forth portion 35. As illustrated in FIG. 4, the liquid surface moving back/forth portion 35 moves back and forth the liquid surface of the liquid 33 held by the liquid holding portion 30, with respect to the paper transport mechanism 4.

As illustrated in FIG. 2, the liquid surface moving back/forth portion 35 includes a syringe 36 and a syringe driving circuit 37. The syringe 36 is connected to the liquid holding portion 30 and functions as a liquid supplying portion that supplies the liquid 33 to the pressure chambers 32. The syringe driving circuit 37 drives and controls the syringe 36. The liquid surface moving back/forth portion 35 is configured to move back and forth the liquid surface of the liquid 33 by decreasing and increasing the pressure against the liquid 33 in the pressure chambers 32 at a predetermined cycle.

As illustrated in FIG. 2, the image forming apparatus 1 includes a controller 40 for controlling the transport belt 18, line heads 6Y, 6M, 6C and 6K, liquid holding portion 30 and the like. The controller 40 is connected with the syringe driving circuit 37, an interface 41, a ROM 42, a RAM 43, an encoder 44, a driving motor control circuit 45, a line head control circuit 46, a fan motor control circuit 47 and the like.

The interface 41 performs data transmission/reception with a host apparatus (not illustrated) that is, for example, a personal computer. The controller 40 converts image signals, which are received via the interface 41, into image data, and outputs control signals to various types of control circuits that are described below.

The ROM 42 stores, for example, a control program for performing the image recording by driving the line heads 6Y, 6M, 6C and 6K. The RAM 43 stores the image data converted by the controller 40 onto predetermined areas.

The encoder 44 is connected to the driving roller 15 on the paper ejection side that drives the transport belt 18, and outputs a pulse string in accordance with the rotational displacement of the rotation shaft of the driving roller 15. The controller 40 calculates the rotational amount of the rotation shaft of the driving roller 15 by counting the number of pulses transmitted from the encoder 44, and determines the amount of paper feed (paper position). The controller 40 outputs control signals to the driving motor control circuit 45 and the line head control circuit 46 based on signals input from the encoder 44.

The driving motor control circuit 45 drives the driving motor 23 based on the output signals of the controller 40. The driving motor 23 drives the driving roller 15 to rotate so as to rotate the transport belt 18 to transport the paper sheet P in the paper transport direction A.

The line head control circuit 46 controls the ink ejection of the line heads 6Y, 6M, 6C and 6K based on the output signals of the controller 40 and the image data stored in the RAM 43. With this control of the line heads 6Y, 6M, 6C and 6K and the control of the driving motor 23 to transport the paper sheet P, the process of recording on the paper sheet P is performed.

The fan motor control circuit 47 drives the fan motor 48 based on the output signals of the controller 40. The fan motor 48 drives the fan 24 to rotate so as to generate a negative pressure in the fan case 25, thereby causing the paper sheet P to be sucked on the transport belt 18.

The syringe driving circuit 37 drives and controls the syringe 36 based on the output signals of the controller 40. The syringe 36, driven and controlled by the syringe driving circuit 37, decreases and increases the pressure against the liquid 33 in the pressure chambers 32 of the liquid holding portion 30 at a predetermined cycle. This causes the liquid surface of the liquid 33 to move up and down in a vertical direction B as illustrated in FIG. 4.

The following describes the examples.

Examples 1-3 were prepared as examples of the image forming apparatus 1 including the above-described liquid holding portion 30, and Comparative Examples 1-3 were prepared as image forming apparatuses not including the liquid holding portion 30. The implementation conditions for the Examples 1-3 and the Comparative Examples 1-3 were the same except for the liquid holding portion 30.

The inkjet head 2 of the image forming apparatuses of the Examples includes the line heads 6Y, 6M, 6C and 6K. The paper transport mechanism 4 was caused to transport A4 size paper sheet P at a speed of 150 sheets/minute (at a transport linear speed of 867 mm/s). The transport belt 18 was formed from a polyimide sheet that was 0.1 mm in thickness. The driving roller 15 was 29.4 mm in diameter and formed from the EPDM rubber that was 1.0 mm in thickness. The vents formed in the transport belt 18 were 2 mm in internal diameter and arranged zigzag at intervals of 8 mm. The rate of a formed image to the whole area of the paper sheet P (printing rate) was 5%.

After the image formation was performed continuously on 10,000 paper sheets P, it was checked how many nozzles 12 of the line heads 6Y, 6M, 6C and 6K could not eject the ink. FIG. 5 illustrates the measurement results of the Comparative Examples, and FIG. 6 illustrates the measurement results of the Examples.

As illustrated in FIG. 5, the average number of clogged nozzles 12 in the Comparative Examples 1-3 was 30.3. In particular, the line head 6Y, which was arranged on the most upstream side in the paper transport direction A, had a significantly larger number of clogged nozzles 12 than the others among the line heads 6Y, 6M, 6C and 6K.

On the other hand, as illustrated in FIG. 6, the average number of clogged nozzles 12 in the Examples 1-3 was 1.7. As a result, it was confirmed that the Examples 1-3 can extremely restrict the nozzles 12 from clogging, compared with the Comparative Examples 1-3.

As explained above, the paper dust, which is generated and stirred up during transport of the paper sheet P, would move toward the inkjet head 2 in the paper transport direction A. In the present embodiment, however, the liquid holding portion 30 is provided on the upstream side of the inkjet head 2 in the paper transport direction A. With this structure, the stirred-up paper dust is sticked to and caught by the liquid 33 held by the liquid holding portion 30 before moving toward the inkjet head 2. This significantly reduces the amount of stirred-up paper dust that moves toward the inkjet head 2 and restricts the nozzles from being clogged with paper dust.

Furthermore, in the present embodiment, the syringe 36 and the syringe driving circuit 37 constituting the liquid surface moving back/forth portion 35 move back and forth the liquid surface of the liquid 33 held by the liquid holding portion 30. This structure enables the liquid 33, which moves back and forth in the vertical direction B as illustrated in FIG. 4, to catch the paper dust positively. This increases the amount of paper dust caught by the liquid 33 of the liquid holding portion 30, thereby further reducing the amount of paper dust that moves toward the inkjet head 2.

Furthermore, the existing structure of inkjet head is used in the liquid holding portion 30, as used in the inkjet head 2. This makes it possible to restrict the increase of the manufacturing cost due to the provision of the liquid holding portion 30. Furthermore, the syringe driving circuit 37 can drive and control the syringe 36 so as to purge liquid 33 that has caught the paper dust, and hold new liquid 33. With this structure, it is possible to catch the paper dust efficiently.

Meanwhile, since the inkjet head 2 is the line head type, the paper sheet P can be transported at a high speed for the recording. With the increase of the paper sheet P transport speed, a more amount of paper dust is generated and the wind speed of the transport wind, which is generated by the paper transport, becomes higher. On the other hand, according to the present embodiment, since the liquid holding portion 30 is provided, even if a large amount of paper dust is generated, the generated paper dust is caught by the liquid holding portion 30. As a result, it is possible to suitably restrict the nozzles 12 of the inkjet head 2 of the line head type from clogging while transporting the paper sheet P at a high speed.

Note that the liquid surface moving back/forth portion 35 may not necessarily include the syringe 36 and the syringe driving circuit 37, but may be configured to move back and forth the liquid surface by oscillating ink in a meniscus. The meniscus may be oscillated by, for example, a known method of applying a predetermined driving waveform to a piezoelectric element to restrict the viscosity of the meniscus from increasing, thereby oscillating the meniscus to an extent that the ink is not ejected.

In the present embodiment, an inkjet recording apparatus of the line head type is described as one example. However, not limited to this, the present disclosure is applicable to, for example, an inkjet recording apparatus of the serial head type.

As explained above, the present disclosure is useful for inkjet recording apparatuses.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An inkjet recording apparatus comprising:

a recording portion having a recording head in which a plurality of nozzles for ejecting ink are formed;

a transport mechanism that is arranged to face the recording portion and configured to transport a paper sheet along the recording portion; and a liquid holding portion that is provided adjacent to and on an upstream side of the recording portion in a transport direction of the paper sheet, and configured to hold liquid in a state where a liquid surface of the liquid faces the transport mechanism, wherein the liquid holding portion includes a nozzle and is configured to hold the liquid which is different from the ink in a state where the liquid protrudes from a tip of the nozzle without being applied to the print sheet during an image forming period.

2. The inkjet recording apparatus according to claim 1, further comprising a liquid surface moving back/forth portion configured to move back and forth the liquid surface of the liquid held by the liquid holding portion, with respect to the transport mechanism, by increasing and decreasing pressure against the liquid in the liquid holding portion.

3. The inkjet recording apparatus according to claim 1, wherein the liquid holding portion is an inkjet head.

4. The inkjet recording apparatus according to claim 1, wherein the recording portion is a line head type.

5. The inkjet recording apparatus according to claim 1, wherein the liquid is water or preservation liquid.

6. The inkjet recording apparatus according to claim 1, wherein the liquid is transparent.

7. The inkjet recording apparatus according to claim 4, wherein the transport mechanism includes a transport belt and a negative pressure generating apparatus, the transport belt being configured to transport the paper sheet, and the negative pressure generating apparatus being configured to generate a negative pressure that causes the transport belt to suck the print sheet, the recording head is a most upstream recording head of a plurality of recording heads, the most upstream recording head provided on a most upstream side of the plurality of recording heads in the transport direction, and the liquid holding portion is provided upstream from the most upstream recording head in the transport direction.

* * * * *